US006181901B1

(12) United States Patent
Zhao et al.

(10) Patent No.: US 6,181,901 B1
(45) Date of Patent: Jan. 30, 2001

(54) MULTICOLOR IMAGE-ON-IMAGE FORMING MACHINE USING REVERSE CHARGE PRINTING (RCP) PROCESS

(75) Inventors: Weizhong Zhao, Webster; Chu-heng Liu, Penfield, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/449,590

(22) Filed: Nov. 29, 1999

(51) Int. Cl.[7] ..... G03G 15/01
(52) U.S. Cl. ..... 399/223; 399/237
(58) Field of Search ..... 399/223, 237, 399/239, 240

(56) References Cited

U.S. PATENT DOCUMENTS

| | | | | |
|---|---|---|---|---|
| 4,267,556 | | 5/1981 | Fotland et al. | 346/153.1 |
| 4,504,138 | | 3/1985 | Kuehnle et al. | 355/10 |
| 4,885,220 | | 12/1989 | Kuhman et al. | 430/31 |
| 5,387,760 | | 2/1995 | Miyazawa et al. | 118/661 |
| 5,436,706 | | 7/1995 | Landa et al. | 355/256 |
| 5,552,863 | * | 9/1996 | Genovese | 399/152 |
| 5,619,313 | | 4/1997 | Domoto et al. | 399/233 |
| 5,826,147 | * | 10/1998 | Liu et al. | 399/237 |
| 5,974,292 | * | 10/1999 | Domoto et al. | 398/237 X |
| 5,987,283 | * | 11/1999 | Zhao et al. | 399/237 |
| 5,991,577 | * | 11/1999 | Liu et al. | 399/237 X |
| 5,991,578 | * | 11/1999 | Liu et al. | 399/237 X |
| 5,991,582 | * | 11/1999 | Liu et al. | 399/237 |

* cited by examiner

*Primary Examiner*—Fred L Braun
(74) *Attorney, Agent, or Firm*—Tallam I. Nguti

(57) ABSTRACT

A multicolor image reproduction machine includes a main assembly having an image bearing member, a controller, and a bias source for biasing the image bearing member. It also includes a plurality of color separation toner image forming units each having a photoreceptor including a photoconductive surface forming a toner image separation development nip with the image bearing member. Each imaging unit also includes a toner supply apparatus for applying a layer of toner of a particular color onto the photoconductive surface; a first charging device for uniformly charging the photoconductive surface; an exposure device connected to the controller for image-wise exposing the photoconductive surface and the layer of toner to form therein image areas and background areas of a desired image; and a second charging device connected to the controller for selectively reversing charge in the background areas of the desired image, so as to enable subsequent separation of the background areas from the image areas. The multicolor image reproduction machine further includes a separation development assembly for separating and developing the image areas of the desired image from the layer of toner and onto the image bearing member of the main assembly to form a multicolor toner image.

8 Claims, 2 Drawing Sheets

MULTICOLOR IMAGE-ON-IMAGE FORMING MACHINE USING REVERSE CHARGE PRINTING (RCP) PROCESS

RELATED CASES

This application is related to U.S. application Ser. No. 09/449,597 entitled "MULTICOLOR IMAGE-ON-IMAGE FORMING MACHINE USING AIR BREAKDOWN CHARGE AND DEVELOPMENT (ABCD) PROCESS" filed herewith on the same date.

BACKGROUND OF THE INVENTION

The present invention relates generally to electrostatic latent image development, and, more particularly, concerns a multicolor image-on-image reproduction machine using a reverse charge printing (RCP) process.

Generally, processes for electrostatographic copying and printing are initiated by selectively charging and/or discharging a charge receptive image bearing member in accordance with an original input document or an imaging signal, generating an electrostatic latent image on the image bearing member. This latent image is subsequently developed into a visible image by a process in which charged developing material is deposited onto the surface of the latent image bearing member, wherein charged particles in the developing material adhere to image areas of the latent image. The developing material typically comprises carrier granules having toner particles adhering triboelectrically thereto, wherein the toner particles are electrostatically attracted from the carrier granules to the latent image areas to create a powder toner image on the image bearing member.

Alternatively, the developing material may comprise a liquid developing material comprising a carrier liquid having pigmented marking particles (or so-called toner solids) charge director materials dissolved therein, wherein the liquid developing material is applied to the latent image bearing image bearing member with the marking particles being attracted to the image areas of the latent image to form a developed liquid image. Regardless of the type of developing material employed, the toner or marking particles of the developing material are uniformly charged and are electrostatically attracted to the latent image to form a visible developed image corresponding to the latent image on the image bearing member.

The developed image is subsequently transferred, either directly or indirectly, from the image bearing member to a copy substrate, such as paper or the like, to produce a "hard copy" output document. In a final step, the image bearing member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface (see, for example, U.S. Pat. No. 4,267,556 and 4,885,220, among numerous other patents and publications), as well as other electrostatic printing systems wherein a charge carrying medium is adapted to carry an electrostatic latent image. It will be understood that the instant invention applies to all various types of electrostatic printing systems and is not intended to be limited by the manner in which the image is formed on the image bearing member or the nature of the latent image bearing member itself.

As described hereinabove, the typical electrostatographic printing process includes a development step whereby developing material is physically transported into contact with the image bearing member so as to selectively adhere to the latent image areas thereon in an image-wise configuration. Development of the latent image is usually accomplished by electrical attraction of toner or marking particles to the image areas of the latent image. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Image quality in electrostatographic printing applications may vary significantly due to numerous conditions affecting latent image formation as well as development, among various other factors. In particular, image development can be effected by charge levels, both in the latent image, as well as in the developing material. For example, when the charge on dry toner particles becomes significantly depleted, binding forces with the carrier also become depleted, causing an undesirable increase in image development, which, in turn, causes the development of the latent image to spread beyond the area defined thereby. Similarly, one problem affecting the control of image quality in ionographic devices involves a phenomenon known as "image blooming" resulting from the effect of previously deposited ions or charge on the path of subsequent ions directed to the charge retentive surface. This problem is particularly noticeable when printing characters and edges of solid areas, resulting in character defects, wherein blooming artifacts may include picture elements being displaced by 1–2 pixels in distance. Image blooming can also be caused by poor charge retention and/or charge migration in the electrostatic latent image on the latent image bearing member, a problem which is particularly prevalent in ionographic systems, wherein a focused beam ion source is utilized for image-wise charging of a dielectric latent image bearing member.

The present invention more particularly, concerns a multicolor image-on-image reproduction machine advantageously using a reverse charge printing (RCP) process, and the following disclosures may be relevant to some aspects of the present invention. U.S. Pat. No. 4,504,138 discloses a method of developing a latent electrostatic charge image formed on a photoconductor surface comprising the steps of applying a thin viscous layer of electrically charged toner particles to an applicator roller preferably by electrically assisted separation thereof from a liquid toner suspension, defining a restricted passage between the applicator roller and the photoconductor surface which approximates the thickness of the viscous layer, and transferring the toner particles from the applicator roller at the photoconductor surface due to the preferential adherence thereof to the photoconductor surface under the dominant influence of the electric field strength of the electrostatic latent image carried by the photoconductive surface, the quantity of toner particles transferred being proportional to the relative incremental field strength of the latent electrostatic image. An apparatus for carrying out the method of the invention is also disclosed, which includes an applicator roller mounted for rotation in a container for toner suspension, an electrode arranged adjacent the circumferential surface of the roller to define an electrodeposition chamber therebetween and electrical connections between the roller, the electrode and a voltage source to enable electrolytic separation of toner particles in the chamber, forming a thin highly viscous layer of concentrated toner particles on the roller.

U.S. Pat. No. 5,387,760 discloses a wet development apparatus for use in a recording machine to develop a toner image corresponding to an electrostatic latent image on an electrostatic latent image carrier. The apparatus includes a development roller disposed in contact with or near the electrostatic latent image carrier and an application head for applying a uniform layer of the wet developer to the roller.

U.S. Pat. No. 5,436,706 discloses an imaging apparatus including a first member having a first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The imaging apparatus also includes an apparatus for supplying liquid toner to the transfer region thereby forming on the second surface a thin layer of liquid toner containing a relatively high concentration of charged toner particles, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the charge bearing surface to form a latent image electrostatically, such that the charge-dissipated portions of the charge bearing surface have the first electrical potential of the charge bearing surface. The method also includes the steps of moving an member biased to a third electrical potential that lies between said first and said second potentials, into a nip forming relationship with the moving image bearing member to form a process nip. The method further includes the step of introducing charged liquid toner having a fourth electrical potential into the process nip, such that the liquid toner sandwiched within the nip simultaneously develops image portions of the latent image onto the member, and background portions of the latent image onto the charge bearing surface of the photoreceptor.

SUMMARY OF THE INVENTION

In accordance with one aspect of the present invention, there is provided a multicolor image reproduction machine that includes a main assembly having an image bearing member, a controller, and a bias source for biasing the image bearing member. It also includes a plurality of color separation toner image forming units each having a photoreceptor including a photoconductive surface forming a toner image separation development nip with the image bearing member. Each imaging unit also includes a toner supply apparatus for applying a layer of toner of a particular color onto the photoconductive surface; a first charging device for uniformly charging the photoconductive surface; an exposure device connected to the controller for image-wise exposing the photoconductive surface and the layer of toner to form therein image areas and background areas of a desired image; and a second charging device connected to the controller for selectively reversing charge in the background areas of the desired image, so as to enable subsequent separation of the background areas from the image areas. The multicolor image reproduction machine further includes a separation development assembly for separating and developing the image areas of the desired image from the layer of toner and onto the image bearing member of the main assembly to form a multicolor toner image.

BRIEF DESCRIPTION OF THE DRAWINGS

For a general understanding of the features of the present invention, reference is made to the drawings, wherein like reference numerals have been used throughout to identify identical or similar elements.

DETAILED DESCRIPTION OF THE INVENTION

While the present invention will be described in terms of an illustrative embodiment or embodiments, it will be understood that the invention is adaptable to a variety of copying and printing applications, such that the present invention is not necessarily limited to the particular embodiment or embodiments shown and described herein. On the contrary, the following description is intended to cover all alternatives, modifications, and equivalents, as may be included within the spirit and scope of the invention as defined by the appended claims.

The present invention relates generally to electrostatic latent image formation, and, more particularly, concerns a multicolor image-on-image reproduction machine using reverse charge printing (RCP) process. A Reverse charge printing (RCP) process as disclosed for example in commonly assigned U.S. Pat. No. 5,826,147 issued Oct. 20, 1998 to Liu et al, relevant portions of which are incorporated herein by reference. As disclosed therein, RCP employs latent image formation, uniform, non-image toner layer coating, a charging or an ion generating device for producing positive or negative ions for image-wise application to background areas and image areas of the coated latent image, and a separation member.

As further disclosed therein, second, selective application of charges to a latent image in the uniform layer of toner, advantageously reverses charge on toner coating background areas of the latent image. Such reverse charging of toner in background areas effectively enables the separation member to selectively remove toner either from the image areas or from the background areas, depending on the bias on the separation member, thus leaving an initial developed toner image on the other surface.

Figure 1:
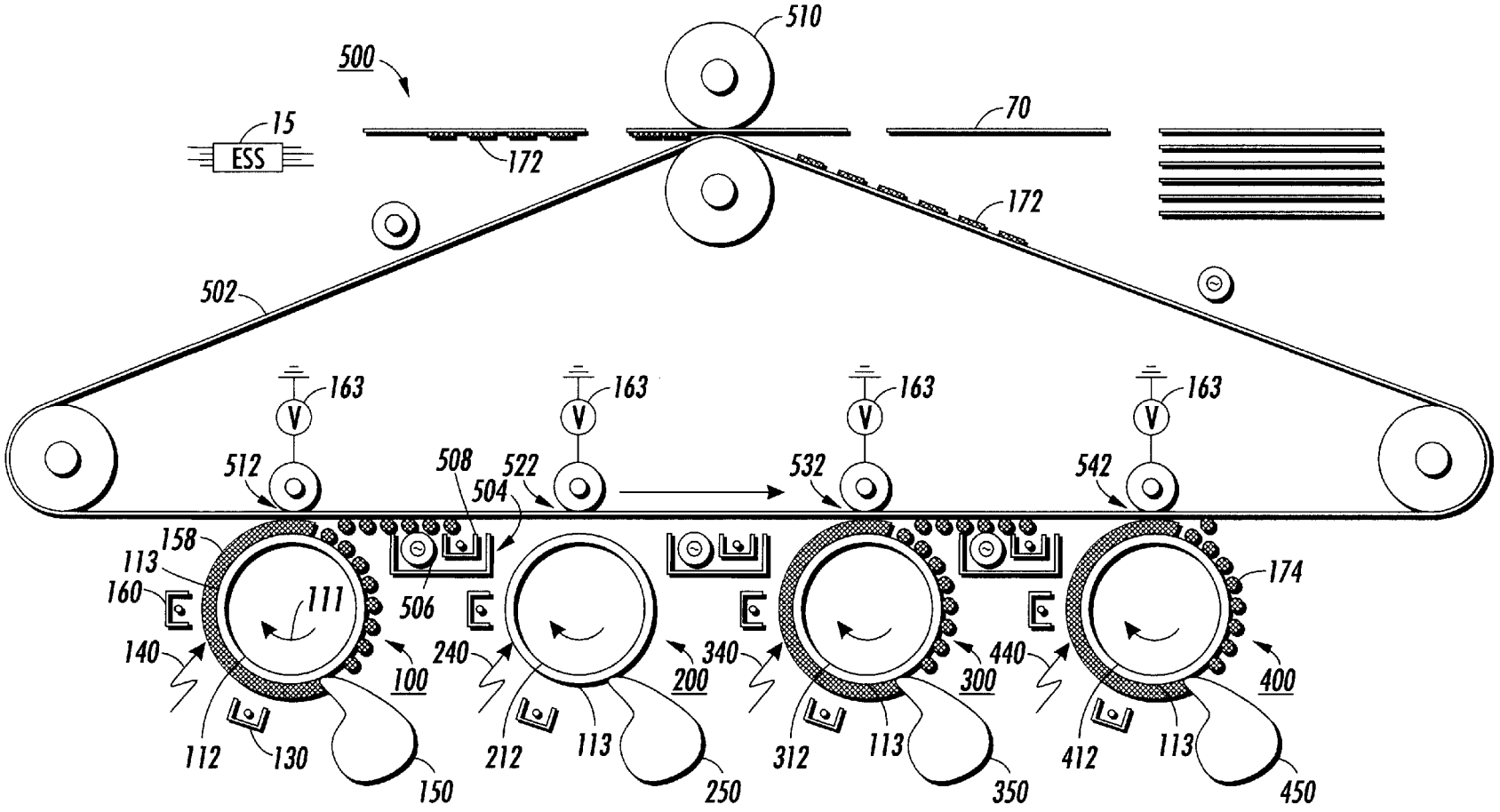
FIG. 1 is a schematic illustration of a tandem multicolor reproduction machine including a plurality of (RCP) imaging units using the process reverse charge printing in accordance with the present invention.

Referring first to FIG. 1 an in accordance with the present invention, there is illustrated a tandem multicolor reproduction machine shown generally as 500. As shown, the tandem multicolor reproduction machine 500 includes a plurality of (RCP) imaging units 100, 200, 300, 400 that each include respectively a photoreceptor member 112, 212, 312, 412, and that each employ a process of reverse charge printing to form a color separation toner image on the photoreceptor. Each color separation toner image is then developed in registration onto a biased image bearing member 502, where it is conditioned by an image stabilization device 504 in accordance with the present invention Referring now to FIGS. 1 and 2, each (RCP) imaging unit 100, 200, 300, 400 as shown comprises an assemblage of operatively associated image forming elements, including a photoreceptor 112, 212, 312, 412 situated in contact with a biased image bearing member 502 at an image separation development nip 512, 522, 532, 542 formed therebetween. Photoreceptor 112, 212, 312, 412 includes an imaging surface of any type capable of having an electrostatic latent image formed thereon. Photoreceptor 112, 212, 312, 412 may include a typical photoconductor or other photoreceptive component of the type known to those of skill in the art in electrophotography, wherein a surface layer having photoconductive properties is supported on a conductive support substrate. Although the following description will describe by example a system and process in accordance with the present invention incorporating a photoconductive photoreceptor, it will be understood that the present invention contemplates the use of various alternative embodiments for photoreceptor 112, 212, 312, 412 as are well known in the art of electrostatographic printing, including, for example, but not limited to, non-photosensitive photoreceptors such as a dielectric charge retaining member of the type used in ionographic printing machines, or electroded substructures capable of generating charged latent images.

Figure 2:
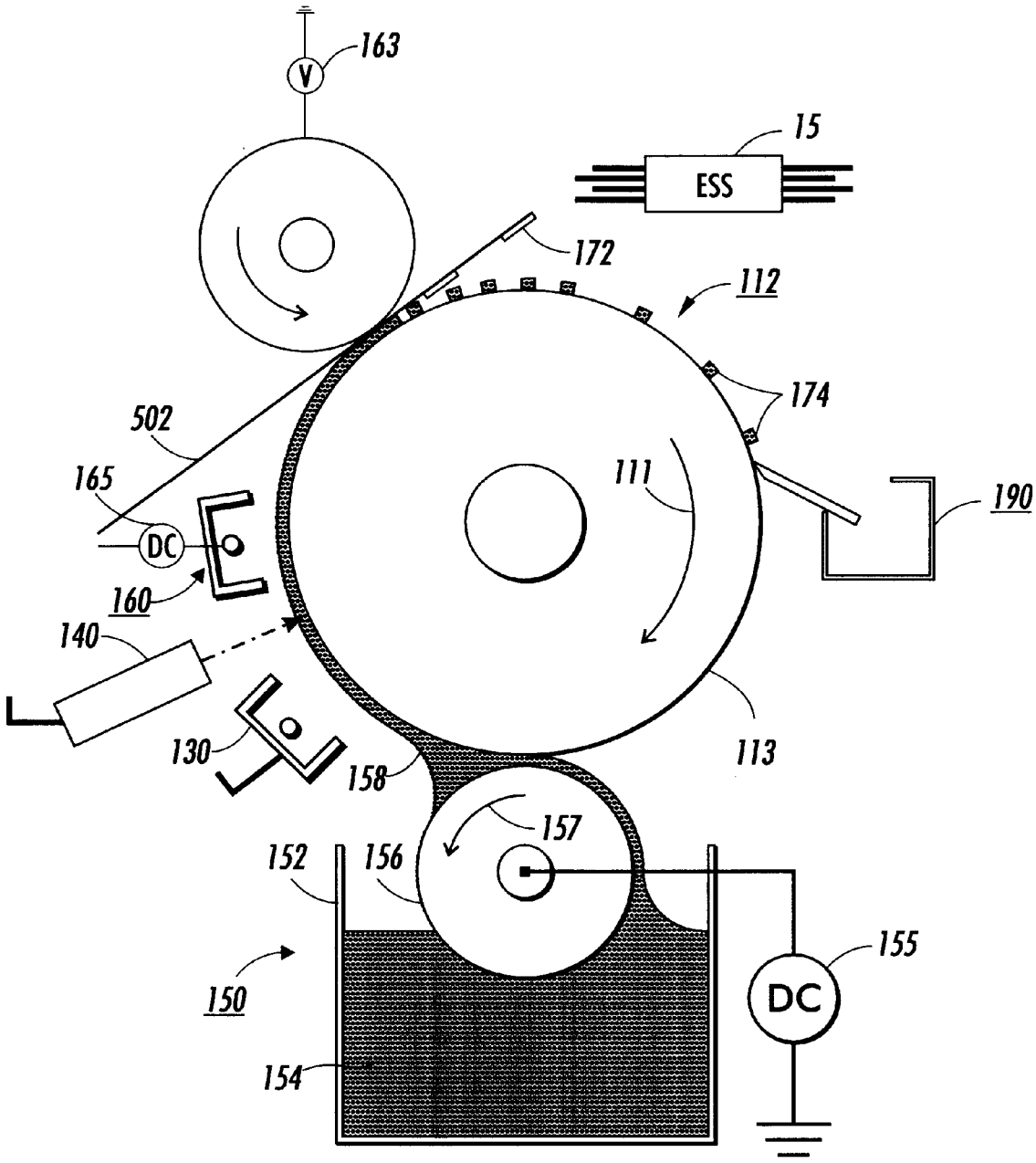
FIG. 2 is an enlarged schematic illustration of a typical (RCP) imaging unit of FIG. 1 using the process of reverse charge printing in accordance with the present invention.

Still referring now to FIGS. 1 and 2, in the RCP process, the photoconductive surface 113 of photoreceptor 112, 212, 312, 412 passes through a series of initial toner image forming assemblies including a toner supply apparatus 150, 250, 350, 450, a first charging device 130, and an exposure device 140, 240, 340, 440 for forming a toner layer or cake 158 and an initial latent image in such toner layer 158. As shown, in accordance with the present invention, in each imaging unit, the photoreceptor 112, 212, 312, 412 is moved first to a toner supply apparatus 150, 250, 350, 450 where the surface 113 thereof is coated with a layer of liquid developer material 154 to form a cake 158. As shown, the toner supply apparatus 150, 250, 350, 450 includes a housing 152 that holds the liquid developer material 154 containing toner solids. The toner supply apparatus 150, 250, 350, 450 also includes an applicator roll 156 that is biased by a source 155. As shown, the applicator roll 156 rotates in the direction of arrow 157 and transports a layer of the developer material 154 into contact with the surface 113 of the photoreceptor 112, 212, 312, 412.

The surface 113 with the layer or cake 158 of toner is next moved to a first charging assembly that includes a corona generating device 130 or any other charging apparatus for applying a uniform level of electrostatic charge to the cake or layer 158 of toner on the surface of the photoreceptor 112, 212, 312, 412. The corona generating device 130 produces a relatively high, and substantially uniform potential. It will be understood that various charging devices, such as charge rollers, charge brushes and the like, as well as induction and semiconductive charge devices among other devices which are well known in the art may be utilized.

After the cake or layer 158 of toner is brought to a substantially uniform charge potential, it is advanced to an image exposure assembly, identified generally by reference numeral 140, 240, 340, 440. Under the control of an electronic subsystem (ESS) controller 15, the image exposure device 140, 240, 340, 440 projects a light image corresponding to an input color separation image about to be reproduced, onto the cake or layer 158 of toner on the photoconductive surface 113. The ESS 15, for example, is the main multi-tasking processor for operating and controlling all of the other subsystems of the multicolor tandem machine 500, and the toner image forming operations of each imaging unit. The light image projected from the image exposure device 140, 240, 340 440 selectively dissipates charge in portions thereof for recording a latent image on the photoconductive surface through the cake or layer 158 of toner, in image configuration, corresponding to the input color separation image. The latent image thus includes image areas having a first charge voltage, and background areas having a second charge voltage, but all of the same polarity as determined by the charge on the toner.

However, in accordance with the present invention, the polarity of unwanted toner in background areas will be reversed by a second charging device 160 of the reverse charge printing (RCP) process, that is mounted downstream of the toner supply apparatus 150, 250, 350, 450. In addition, other image defects known as edge smearing due to toner spreading over the image-background boundary onto the background area, such as dragout in liquid immersion development, will be significantly reduced or eliminated, advantageously resulting in high resolution and sharp edges for wanted toner solids in image areas of the final toner image.

Accordingly, the exposed photorecptor with the cake or layer 158 of toner is next moved to the second charging device 160 where under control of the ESS 15, it is recharged in an image-wise manner. The second charging device 160 can be a well known scorotron device that is used herein for producing an image-wise stream of free mobile ions in the vicinity of the initial developed toner image on the surface of the photoreceptor 112, 212, 312, 412. The second charging device 160 includes a DC biasing source 165 coupled thereto for providing a biasing voltage thereto to generate ions having a single charge polarity. The image-wise ion stream and its polarity are selected so as to effectively reverse the charge on toner solids in only the background areas, and not in the image areas of the latent image formed by exposure device 140, 240, 340, 440.

After the second charging device 160 reverses charge on toner within background areas of the latent image in the toner "cake" or layer 158 of toner, the toner "cake" or layer 158 toner is then moved to and through the image separation development nip 512, 522, 532, 542. As shown, the image separation development nip 512, 522, 532, 542 is formed by the surface 113 of the photoreceptor 112, 212, 312, 412 and the image bearing member 502. As further shown, the image bearing member 502 is biased at the image separation development nip 512, 522, 532, 542 by an electrical biasing source 163 capable of providing an appropriate voltage potential sufficient to attract image areas 172 from the cake or layer 158 of toner on the surface 113.

As mentioned, the polarity of the bias source 163 is such as to bias the image bearing member 502 (at the image separation development nip, 512, 522, 532, 542) for attracting image areas 172 from the toner cake or layer 158. This results in image development by which image areas 172 of the toner cake 158 are separated and transferred onto the surface of the biased image bearing member 502, while leaving background image areas 174 on the surface 113 of the photoreceptor 112, 212, 312, 412.

In a final step on each imaging unit 100, 200, 300 400, the background areas 174 left on the photoreceptor after image transfer to the mage bearing member 502 is either recycled into the toner supply apparatus (FIG. 1) or removed from the surface thereof by a cleaning unit 190 (FIG. 2) in order to clean the surface in preparation for a subsequent imaging cycle. FIG. 2 illustrates a simple blade cleaning apparatus for scraping the photoreceptor surface as is well known in the art. Alternative embodiments may include a brush or roller member for removing toner from the surface on which it resides.

Referring in particular to FIG. 1, after the image areas 172 from each of the imaging units 100, 200, 300, 400, for example imaging unit 100, are developed as above onto the biased image bearing member 502 as a color separation toner image, it is conditioned and stabilized by an image stabilization device 504 as shown prior to the development and transfer of a the subsequent color separation toner image by the next imaging unit. As shown, image stabilization device 504 comprises a preferably heated pressure roller 506, and charging unit 508. The pressure roller 506 is made suitable for contacting the image areas or toner image 172 on the image bearing member 502 in order to increase toner layer strength by taking out carrier liquid from the toner image. Heat from the heated pressure roller 506 operates to increase toner layer strength by fusing or partially fusing the toner image on the image bearing member 502. The charging unit 508 for example is a corona device, and preferably has the same polarity as the polarity of the charge on the toner forming the image areas 172.

In accordance with the present invention, the charging device 130 for each imaging unit 100, 200, 300, 400 charges the layer of toner 158 to a polarity that is opposite that of the bias source 163 for biasing the image bearing member 502. On the other hand, charging unit 508 of the image stabilization device 504 charges the color separation toner image 172 to the same polarity as that of the charging device 130 of each the imaging units.

Such advantageous effects of heat can also be obtained without contact using a radiant heat source to increase toner layer strength by crosslinking polymer chains of toner particles forming the toner image on the image bearing member. In any case, the image stabilization device 504 thus conditions and stabilizes the color separation toner image so that minimum disturbances thereof will occur at the next image separation development nip. It also prevents color contamination at such next image separation development nip, as well as enhances the toner layer cohesiveness by increasing the solid concentration partially coalescing the toner particles. The image stabilization device 504 is additionally preferable in order to avoid any back transfer of the toner image already on the image bearing member 502 to the next photoreceptor, for example, due to wrong sign toner.

After each of the imaging units 100, 200, 300, 400 has formed and developed a color separation toner image to form a multicolor composite image on the surface of the biased image bearing member 502 as above, the multicolor composite image may then be transferred to a copy substrate 70. As shown such transfer may be via any means known in the art, which may include an electrostatic transfer apparatus including a corona generating device of the type previously described or a biased transfer roll. In a preferred embodiment, as shown in FIG. 1, the image is transferred to a copy substrate 70 via a heated pressure roll 510, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent.

In the present invention, the full or multicolor composite toner image is built up directly on a biased image bearing member 502 as opposed to a conventional intermediate transfer member. This advantageously enables easily holding the image electrostatically on the image bearing member 502, thus preventing degradation or smearing of the previous image in the next development nip.

As can be seen, there has been provided a multicolor image reproduction machine that includes a main assembly having an image bearing member, a controller, and a bias source for biasing the image bearing member. It also includes a plurality of color separation toner image forming units each having a photoreceptor including a photoconductive surface forming a toner image separation development nip with the image bearing member. Each imaging unit also includes a toner supply apparatus for applying a layer of toner of a particular color onto the photoconductive surface; a first charging device for uniformly charging the photoconductive surface; an exposure device connected to the controller for image-wise exposing the photoconductive surface and the layer of toner to form therein image areas and background areas of a desired image; and a second charging device connected to the controller for selectively reversing charge in the background areas of the desired image, so as to enable subsequent separation of the background areas from the image areas. The multicolor image reproduction machine further includes a separation development assembly for separating and developing the image areas of the desired image from the layer of toner and onto the image bearing member of the main assembly to form a multicolor toner image.

It will be understood that the apparatus and processes described hereinabove represent only a few of the numerous system variants that could be implemented in the practice of the present invention.

We claim:

1. A multicolor image-on-image reproduction machine comprising:

(a) a main assembly including a movable image bearing member having a path of movement, a controller, and a bias source for biasing said image bearing member to receive and carry toner images;

(b) a plurality of reverse charge printing (RCP) imaging units mounted along said path of movement of said image bearing member, each (RCP) imaging unit of said plurality thereof including:

(i) a movable photoreceptor including a photoconductive surface forming a toner image separation development nip with said movable image bearing member;

(ii) a toner supply apparatus for applying a layer of toner particles having a particular color onto said photoconductive surface of said photoreceptor;

(iii) a first charging device for uniformly charging said photoconductive surface;

(iv) an exposure device, connected to said controller and mounted downstream of said first charging device, relative to movement of said photoreceptor, for image-wise exposing photoconductive surface and said layer of toner particles to form therein image areas and background areas of a desired image; and (v) a second charging device connected to said controller for selectively recharging the background areas of the desired image in said layer of toner particles, so as to enable separation of said background areas from said image areas of the desired image;

(d) separation development means for separating and developing said image areas of the desired image from said layer of toner particles on said photoconductive surface of said photoreceptor onto said image bearing member of said main assembly, to form a multicolor toner image; and (e) an image stabilization unit mounted downstream of each said image separation development nip, relative to movement of said image bearing member, and interacts with said color separation toner image, for increasing a toner layer strength of said color separation toner image prior to subsequent transfer onto said image bearing member of another color separation toner image, said image stabilization unit including a pressure roller and a charging unit.

2. The multicolor image-on-image reproduction machine of claim 1, wherein said first charging device is mounted downstream of said toner supply apparatus, relative to movement of said photoreceptor.

3. The multicolor image-on-image reproduction machine of claim 1, wherein said first charging devices charges photoconductive surface through said layer of toner particles thereon.

4. The multicolor image-on-image reproduction machine of claim 1, wherein said first charging device for each imaging unit charges said layer of toner to a polarity opposite that of said bias source for biasing said image bearing member.

5. The multicolor image-on-image reproduction machine of claim 1, wherein said second charging device includes a DC bias source for producing a desired polarity in said layer of toner.

6. The multicolor image-on-image reproduction machine of claim 1 wherein said pressure roller of said image stabilization unit is heated.

7. The multicolor image-on-image reproduction machine of claim 1 wherein said charging unit of said image stabilization device charges said color separation toner image to a same polarity as said first charging device of each said imaging unit.

8. The multicolor image-on-image reproduction machine of claim 1 including a biasing source for biasing said image stabilization unit, said biasing source having a same polarity as said first charging device of each said imaging unit.

* * * * *